US005127871A

United States Patent [19]

Miller

[11] Patent Number: 5,127,871

[45] Date of Patent: Jul. 7, 1992

[54] SOFT SWORD WITH INTERCHANGEABLE GUARDS

[76] Inventor: Ronald C. Miller, 204 Yorktown Dr., Chapel Hill, N.C. 27516

[21] Appl. No.: 659,998

[22] Filed: Feb. 22, 1991

[51] Int. Cl.[5] ..... A63H 33/00

[52] U.S. Cl. ..... 446/473; 482/12

[58] Field of Search ..... 446/473, 144, 405, 486; 272/98, 8 N, 8 R; 273/84 R, 67 R, DIG. 4; 30/295, 340

[56] References Cited

U.S. PATENT DOCUMENTS

| | | | |
|---|---|---|---|
| 1,784,334 | 12/1930 | Callum | 30/295 |
| 2,204,789 | 6/1940 | Bredow | 273/84 R X |
| 2,803,087 | 8/1957 | Zalkind | 446/473 |
| 2,826,859 | 3/1958 | Shaffer | 272/8 N X |
| 3,538,605 | 11/1970 | Smith | 30/295 |
| 4,079,936 | 3/1978 | Schachter | 273/67 R |
| 4,328,966 | 11/1982 | Miyamoto | 273/67 R X |
| 4,892,303 | 1/1990 | Lohre | 446/473 X |

*Primary Examiner*—Mickey Yu
*Attorney, Agent, or Firm*—Olive & Olive

[57] ABSTRACT

A flexible foam sword which includes a one-piece sword piece and a guard piece. The sword piece contains a blade portion and a handle portion. The guard piece may be constructed in a variety of shapes and contains at least one hole of such size and shape so as to slidably fit onto the handle portion of the sword piece. The blade portion, at its base, is wide enough to prevent the guard piece from sliding down onto the blade portion. The handle portion contains a knob at its base to prevent the guard piece from sliding back off of the handle portion.

11 Claims, 3 Drawing Sheets

SOFT SWORD WITH INTERCHANGEABLE GUARDS

BACKGROUND OF THE INVENTION

Field of the Invention

This invention relates to toy swords. In particular, this invention pertains to a flexible, foam sword with interchangeable foam guards.

Description of the Related Art

There are a wide variety of foam-containing and other types of flexible toy swords or sword-like toy weapons. For example, there are foam swords attached to plastic handles or wooden handles covered with foam, or swords that have internal support elements for the sword blade (U.S. Pat. No. 4,892,303 to Gunther, U.S. Pat. No. 4,328,966 of Miyamoto and U.S. Pat. No. 2,803,087 of Zalkind). The guards are generally attached to the handle base by cementing or screws.

Toy swords on the market which are made of foam are generally made of foam which is hard and brittle and breaks easily, or is very soft and spongy and tears easily. Thus, previous swords are not both firm and indestructible. Swords made of foams that are stiff, or swords that use screws as attachment means, create possible safety hazards for children and may cause eye or other wounds during rough play. Previous foam swords also are generally constructed with one particular type of guard, and do not allow interchanging of different types of sword guards.

It is therefore an object of this invention to provide a foam sword that is nearly indestructible, but is not dangerous for ordinary or even quite rough play and cannot be torn or chewed easily.

It is a further object of this invention to provide a toy sword which has interchangeable guards.

It is a further object of this invention to provide a foam sword which may be used for training for competitive fencing.

Other objects and advantages will be more fully apparent from the following disclosure and appended claims.

SUMMARY OF THE INVENTION

The sword of the invention comprises:

(a) a flexible first piece having a handle portion and a blade portion; and (b) a flexible guard piece having at least one hole, said hole being of a size and shape to fit on to said handle.

Preferably the first piece and guard piece are made of a light, flexible, durable, nontoxic nonflammable foam with a high tensile strength. Preferably the sword is provided with a plurality of guard pieces so that the user may interchange them at will. The preferred guard piece for general use comprises two holes for insertion of the sword so that the guard curves around the handle of the sword when placed on the handle. Other guard pieces that may be provided include a Ninja type guard piece, a broad sword or gladiator type guard piece, a cavalry saber guard piece, a foil guard piece, and an epee' guard piece.

The sword may be used as a toy sword, which when hit against a object bends without breaking. The sword may also be used as a training sword, in which case the length of the blade portion may be extended, and the handle wrapped with enforcing material. In any case, however, the sword portion and handle portion remain bendable and resilient. The sword may also be shaped like a competitive blade in which case the blade portion could be lengthened, more tapered, and wrapped to give it some rigidity.

Because of the variety of types of swords and the variety of ways one may use the swords, sword kits are contemplated. The kits would include a sword piece, a variety of guard pieces and safety glasses. Although the sword is flexible and without a hard surface, safety glasses should be considered especially when the sword is used by smaller children who may get carried away in rough play.

Other aspects and features of the invention will be more fully apparent from the following disclosure and appended claims.

Figure 1:
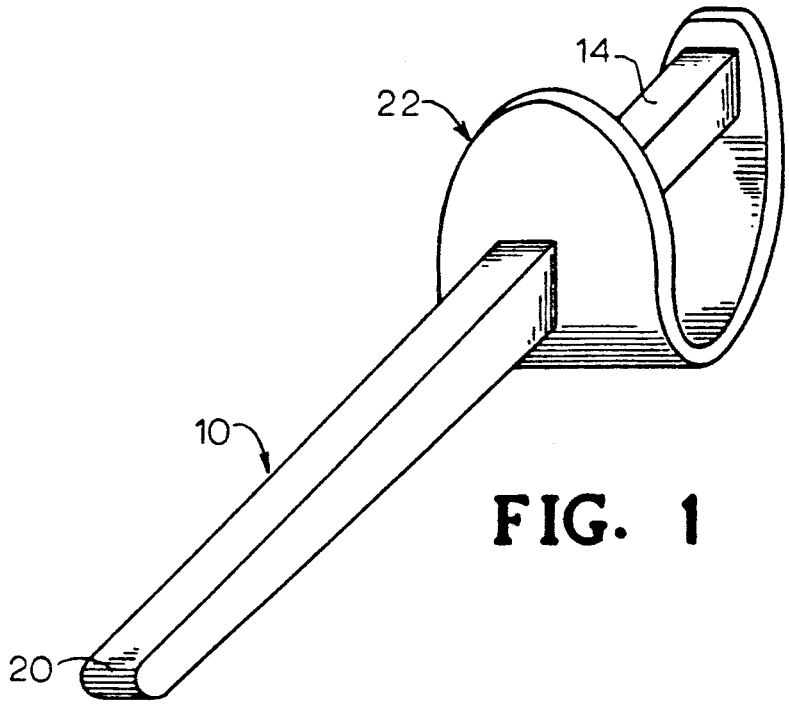
FIG. 1 is a perspective view of a sword and guard piece according to the invention.
Figure 2:
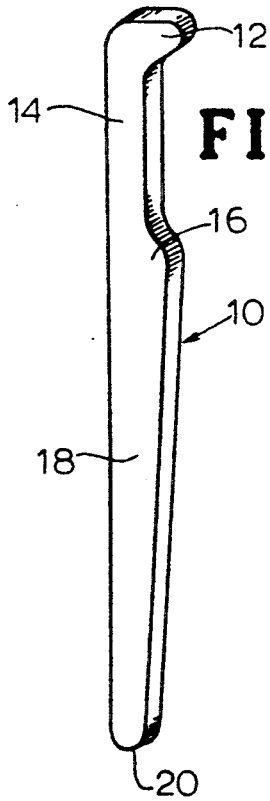
FIG. 2 is a perspective view of the sword piece of FIG. 1.

DETAILED DESCRIPTION OF THE INVENTION AND PREFERRED EMBODIMENTS THEREOF present invention, indicated generally at FIG. 1, is a sword comprising sword piece 10 and guard piece 22 both made entirely of a durable, flexible foam. Sword piece 10, shown in FIG. 2, is a singular piece comprised of knob 12, grip 14, blade base 16, blade portion 18 and blade tip 20. In the preferred embodiment, shown in FIG. 3, guard piece 22, also a singular piece, forms a tapered oval with first aperture 24 and second aperture 26 at opposite ends of guard piece 22. Apertures 24 and 26 are sized and shaped to slide over knob 12 and fit on to grip 14.

The preferred length of sword piece 10 is approximately 61 cm for the toy model, and approximately 71 cm for the competitive training model, but any length may be made according to the desired use. Sword piece 10 is preferably cut from a piece of foam about 3 cm thick. Knob 12 forms one end of sword piece 10 and acts as a base for grip 14. A user of the sword holds the sword at grip 14 which is preferably approximately 3 cm wide, 4 cm high and approximately 15 cm long from knob 12 to blade base 16.

Blade portion 18 extends from blade base 16 and narrows slightly to blade tip 20. The preferred width of blade portion 18 at blade base 16 as cut from the approximately 3 cm thick foam is approximately 5 cm tapering down to approximately 3 cm just prior to the rounded off blade tip 20.

Figure 3:
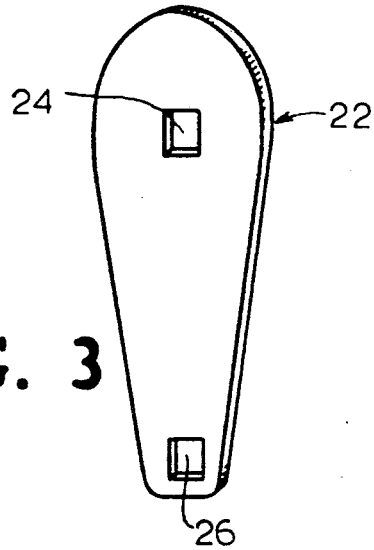
FIG. 3 is a perspective view of the guard piece of FIG. 1.
Figure 4:
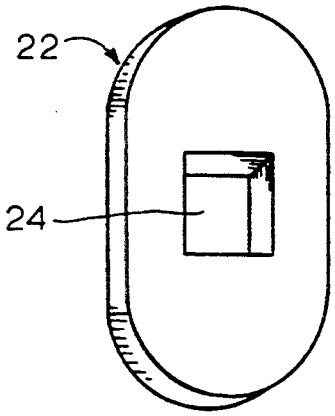
FIG. 4 is a perspective view of a Ninja type guard piece.
Figure 5:
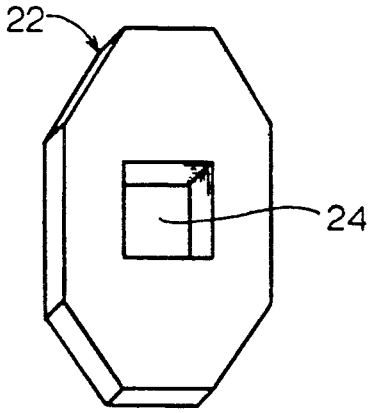
FIG. 5 is a perspective view of a second Ninja type guard piece.
Figure 6:
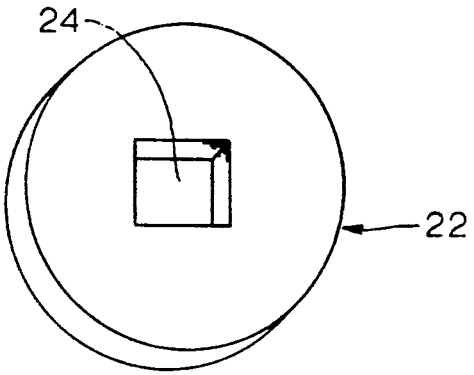
FIG. 6 is a perspective view of a foil or epee' guard piece.
Figure 7:
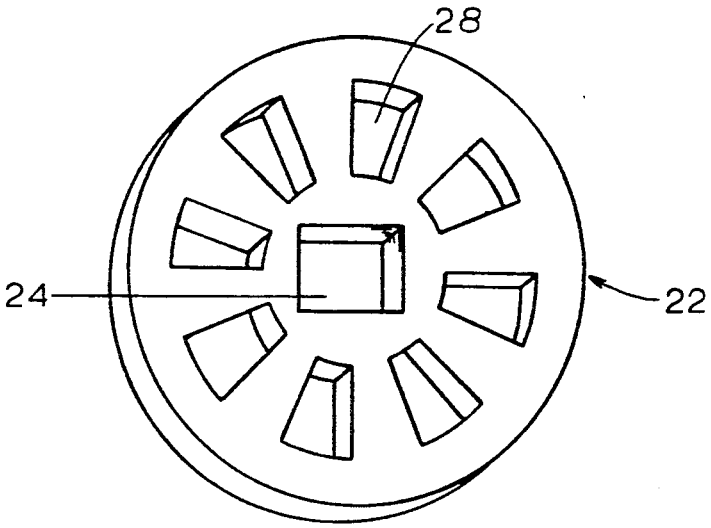
FIG. 7 is a perspective view of a rapier guard piece.
Figure 8:
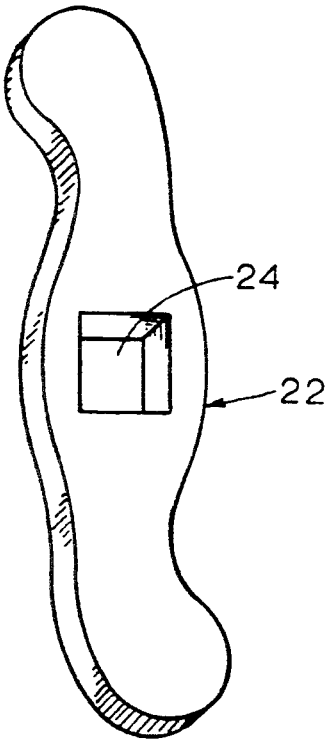
FIG. 8 is a perspective view of a broad sword guard piece.
Figure 9:
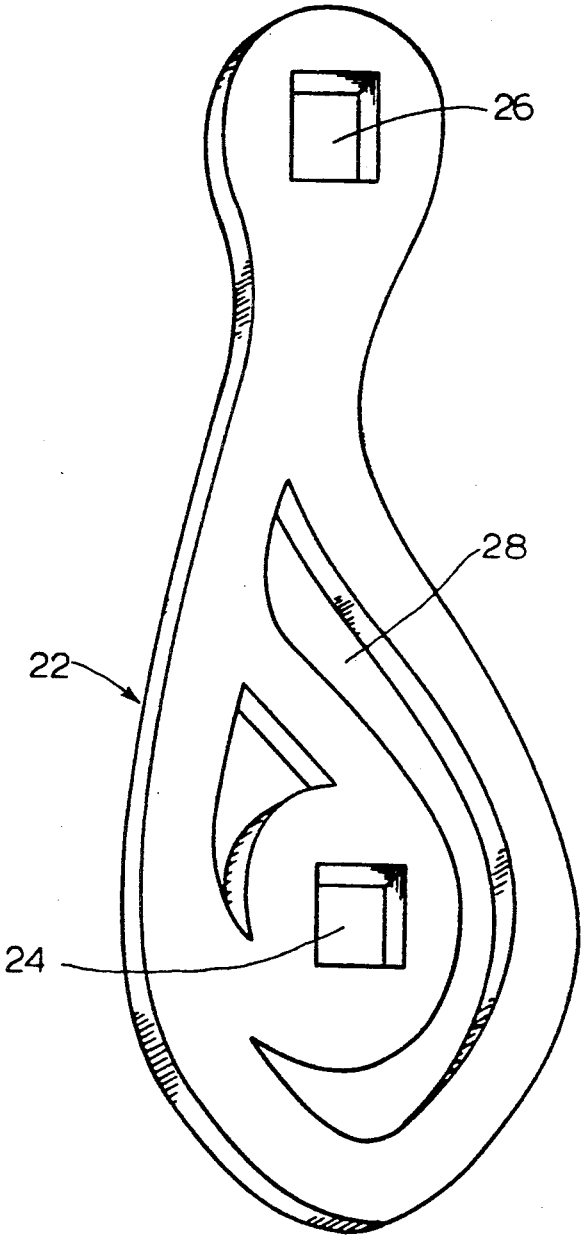
FIG. 9 is a perspective view of a cavalry saber guard piece.

The preferred guard is the embodiment shown in FIGS. 1 and 3 which has two holes for insertion of the handle although guard pieces having the shapes shown in FIGS. 4–9 may be used for particular purposes. This guard is preferably shaped in the form of a tapered oval having a wider top end and a narrower bottom end. Almost equidistant from the top and side edges of guard piece 22, approximately 6–7 cm from each edge, is first aperture 24. A preferred size of first aperture 24 is approximately 3 cm extending across guard piece 22 and 3.7 cm extending the length of guard piece 22. The size of first aperture 24 is sufficient to allow insertion of knob 12 and grip 14 of sword piece 10, but not so large to allow guard piece 22 to slip off of or rotate around sword piece 10. Because the foam is pliable, the actual size of first aperture 24 may be smaller than the cross-sectional area of the handle or knob. First aperture 24 is smaller in length than the width of blade base 16, thus preventing guard piece 22 from slipping onto blade portion 18 and keeping guard piece 22 on grip 14, shown in FIG. 1.

At the bottom narrower end of guard piece 22 is second aperture 26 also located approximately equidistant from the bottom and side edges of guard piece 22 and is preferably the same approximate size as first aperture 24. Aperture 26 is preferably centered in the bottom narrower end, approximately 2–3 cm from the edges. As with first aperture 24, the size of second aperture 26 is sufficient to allow insertion of knob 12 and grip 14, but not so large to allow guard piece 22 to slip off sword piece 10. Second aperture 26 is smaller in length than the width of knob 12, thus preventing guard piece 22 from slipping off of grip 14. In the guard pieces 22 shown in FIGS. 4–8, only one aperture 24 is present and the guard piece 22 does not wrap around the hand. The cavalry saber (FIG. 9) and the rapier (FIG. 7) have additional apertures 28 for design purposes.

Sword piece 10 and guard piece 22 are preferably cut from flat PLASTAZOTE ® sheets (BXL Plastics Ltd., Croydon, Surrey, England) of thicknesses ranging from 1.5 cm to 3 cm. Most preferably, guard piece 22 is constructed from PLASTAZOTE ® of 1.5 cm thickness, and sword piece 10 is constructed from sheets 3 cm thick. The preferred foam material is PLASTAZOTE ® because of its durability, density, nontoxicity and nonflammability. PLASTAZOTE ® is a closed cell cross-linked polyethylene foam produced from LD polyethylene, and manufactured in many colors. The foam is lightweight, with a density (nominal) of 2.8 lb/cubic foot. It is both durable and flexible, making it ideal for use as a toy or training sword. Because it has a tensile strength of 59 lbf/square inch (pound force per square inch), it can be bent to a large degree during use without breaking. It can also withstand a significant amount of pulling and chewing without breaking or tearing because elongation at break is 100%. However, because it is also lightweight, play sword fighting with the foam sword is relatively harmless and non-injurious. Other typical properties of the preferred foam include:

| | |
|---|---|
| Compression set (Average figures using skin/skin thickness samples) | |
| a) 20% compression for 48 hr at 68° F.; ½ hr recovery | 13% |
| b) 40% compression for 70 hr at 68° F.; ½ hr recovery | 16% |
| Maximum static loading | |

-continued

| | |
|---|---|
| Up to 122° F. | 2.0 lbf/in$^2$ |
| Above 122° F. | 1.2 lbf/in$^2$ |
| Lowest recommended working temperature | −94° F. |
| Highest recommended continuous temperature | 158° F. |
| Thermal conductivity | 0.32 BTU/(hr) (ft$^2$) (°F./in) |
| Co-efficient of thermal expansion | 0.00025/°F. |
| Modulus of elasticity in compression | |
| Loading range 2–8 lbf/in$^2$ | 79.8 lbf/in$^2$ |
| Loading range 10–20 lbf/in$^2$ | 34.8 lbf/in$^2$ |
| Water vapor transmission at 100° F. and 1–90% relative humidity gradient | 7 grains/ft$^2$/24 h/2 in |
| Water absorption after 6 weeks total immersion | 3.5% vol/vol |
| Corrosion at 158° F. for 7 days | Does not attack aluminum, copper, silver, brass or steel. |

Because PLASTAZOTE ® contains closed cells, i.e., not interconnecting passages, the foam does not absorb water or other liquids. It can therefore be washed if necessary. The foam sword may also be used in water play because PLASTAZOTE ® is also buoyant.

Additionally, PLASTAZOTE ® is nonflammable (pyrolysis occurring at temperatures above 572° F.) and is biologically and chemically inert, thus nontoxic. The characteristics of this material make it ideal for use as a toy sword or training sword.

Because of the versatility of the PLASTAZOTE ® sheets and the ease with which the sheets may be cut, guard pieces 22 may be cut with intricate designs. The only limitation to the intricacy of the design is that the design should not be cut too close to the edge of guard piece 22 so as not to create weak edges for guard piece 22. Alternatively, PLASTAZOTE ® sword pieces may be created by forming the PLASTAZOTE ® directly in the desired shapes by pouring the substance into molds. In this manner even more intricate and sturdy guard pieces 22 may be made without needing to cut the PLASTAZOTE ®.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A simulated sword which comprises:

(a) a flexible first piece comprising:

(i) a bendable handle portion having a distal knob, and (ii) a bendable blade portion having a blade base adjacent said handle portion, said handle portion and said blade portion having the same thickness, said blade base having a greater width than the handle portion; and (b) a flexible guard piece having at least one hole, said hole being of a size and shape to fit over said knob for placement on said handle, but being small enough relative to the blade base width to keep the guard piece from sliding from the handle portion onto the blade base.

2. A simulated sword according to claim 1, wherein said guard piece has two holes and said guard piece slidably fits onto said handle portion being secured thereon by said knob and the blade base of said blade portion.

3. A simulated sword according to claim 1, wherein said first piece and said guard piece are constructed entirely from a polyethylene foam.

4. A simulated sword according to claim 3, wherein said polyethylene foam is made of PLASTAZOTE ®.

5. A simulated sword according to claim 1, wherein said first piece and said guard piece are constructed of a foam having a tensile strength of about 59 $lbf/in^2$, an elongation at break of about 100% and a modulus of elasticity in compression of about 80 $lbf/in^2$ for a loading range of 2–8 $lbf/in^2$.

6. A simulated sword kit comprising:

(a) a flexible first piece comprising:

(i) a bendable handle portion having a distal knob, and (ii) a bendable blade portion having a blade base adjacent said handle portion, said handle portion and said blade portion having the same thickness, said blade base having a greater width than the handle portion; and (b) a flexible guard piece having at least one hole, said hole being of a size and shape to fit over said knob for placement onto said handle, but being small enough relative to the blade base width to keep the guard piece from sliding from the handle portion onto the blade base; and (c) a pair of safety glasses.

7. A simulated sword kit comprising:

(a) a flexible first piece comprising:

(i) a bendable handle portion having a distal knob, and (ii) a bendable blade portion having a blade base adjacent said handle portion, said handle portion and said blade portion having the same thickness, said blade base having a greater width than the handle portion; and (b) a plurality of flexible guard pieces, each of said guard pieces having at least one hole, said hole being of a size and shape to slidably fit over said knob for placement onto said handle, but being small enough relative to the blade base width to keep the guard piece from sliding from the handle portion onto the blade base.

8. A simulated sword kit according to claim 7 further comprising a pair of safety glasses.

9. A simulated kit according to claim 7 wherein said first piece and said guard pieces are constructed entirely of a polyethylene foam.

10. A simulated sword kit according to claim 9, wherein the polyethylene foam is made of PLASTAZOTE ®.

11. A simulated sword kit according to claim 7, wherein said first piece and said guard piece are constructed of a foam having a tensile strength of about 59 $lbf/in^2$, an elongation at break of about 100% and a modulus of elasticity in compression of about 80 $lbf/in^2$ for a loading range of 2–8 $lbf/in^2$.

* * * * *